US007061504B1

(12) United States Patent
Glen

(10) Patent No.: US 7,061,504 B1
(45) Date of Patent: Jun. 13, 2006

(54) METHOD AND APPARATUS FOR CONFIGURABLE GAMMA CORRECTION IN A VIDEO GRAPHICS CIRCUIT

(75) Inventor: David I. J. Glen, Toronto (CA)

(73) Assignee: ATI International SRL, Christchurch (BB)

( * ) Notice: Subject to any disclaimer, the term of this patent is extended or adjusted under 35 U.S.C. 154(b) by 0 days.

(21) Appl. No.: 09/272,069

(22) Filed: Mar. 18, 1999

(51) Int. Cl.
*G09G 5/02* (2006.01)

(52) U.S. Cl. ..... 345/600; 345/601; 345/602

(58) Field of Classification Search ..... 345/600, 345/601, 602, 605, 690; 382/167
See application file for complete search history.

(56) References Cited

U.S. PATENT DOCUMENTS 5,359,702 A * 10/1994 Mukai ..... 345/601
5,563,725 A * 10/1996 Kumada et al. ..... 345/601
5,671,021 A * 9/1997 Kumada et al. ..... 345/600
5,774,112 A * 6/1998 Kasson ..... 345/601
5,805,175 A * 9/1998 Priem ..... 345/601
5,844,532 A * 12/1998 Silverbrook et al. ..... 345/600
6,157,396 A * 12/2000 Margulis et al. ..... 345/545
6,323,854 B1 * 11/2001 Knox et al. ..... 345/418
6,388,648 B1 * 5/2002 Clifton et al. ..... 345/601 X
6,404,512 B1 * 6/2002 Tone ..... 345/690

* cited by examiner

*Primary Examiner*—Amr A. Awad
*Assistant Examiner*—Chante Harrison
(74) *Attorney, Agent, or Firm*—Vedder, Price, Kaufman & Kammholz, P.C.

(57) ABSTRACT

A method and apparatus for gamma correction in a video graphics circuit is accomplished by storing a plurality of gamma correction curves in one or more lookup tables that can be accessed using pixel display information to generate gamma-corrected data. Gamma correction selection information is provided to select which of the gamma correction curves is utilized to perform the gamma correction for a particular set of pixel data.

16 Claims, 4 Drawing Sheets

METHOD AND APPARATUS FOR CONFIGURABLE GAMMA CORRECTION IN A VIDEO GRAPHICS CIRCUIT

FIELD OF THE INVENTION

The invention relates generally to display of video graphics data and more particularly to gamma correction for video graphics displays.

BACKGROUND OF THE INVENTION

Computers are used in a number of different video graphics applications that produce images on a display. When images are produced on a display, the intensity of the different pixels that make up the image can effect the quality of the image as perceived by a viewer. The intensity of pixels on the display is related to the voltage provided to the display for generation of the pixels. The formula that determines the intensity of a pixel on a display is Intensity=(V+), where V is voltage, is black level adjust parameter, and is the associated gamma value. The black level parameter corresponds to the brightness adjustment for a particular display device.

Problems arise because the gamma and black level adjust used in the equation above are different for different computer monitors, television sets, flat panels, other types of displays, and printers. Typically, the gamma of a computer monitor is approximately 2.5. This makes the intensity equation a non-linear relationship such that if the gamma is not corrected for, mid-tone values of an image will have a lower intensity than would be proportionately correct.

Different computer platforms have implemented various types of gamma correction. As such, applications intended for one computer platform may perform some type of gamma correction that is inappropriate if utilized on another platform. For example, SGI (Silicon Graphics) machines employ a hardware gamma correction of approximately 1.4, whereas Macintosh machines employ gamma correction using a value of approximately 1.7. In contrast, typical compatible personal computers (PCs) have no default gamma correction built into the display subsystem.

Video and 2D graphics are typically received with a gamma of ~2.3 pre-applied. The data is received with the assumption that the display subsystem applies no further correction and that the display device being utilized is a CRT. However, 3D graphics are often rendered to a linear gamma space with the assumption that the display subsystem will adjust it.

Processing data which is already gamma corrected can lead to complications when the processing system must compensate for the already present gamma correction. Ideally, the image processors would be able to process the images in linear space and allow the display system to provide the proper gamma correction for whatever display device is being utilized. Ideally, such systems would be able to account for multiple windows on a single display where each window may have a different gamma value associated with it because of the image data it is displaying.

Therefore, a need exists for a method and apparatus that allows for linear processing of image data which is then gamma corrected prior to display, where the gamma correction is capable of dealing with a number of different gamma values.

DETAILED DESCRIPTION OF A PREFERRED EMBODIMENT OF THE INVENTION

Generally, the present invention provides a method and apparatus for gamma correction in a video graphics circuit. This is accomplished by storing a plurality of gamma correction curves in one or more lookup tables that can be accessed using pixel display information to generate gamma-corrected data. Gamma correction selection information is provided to select which of the gamma correction curves is utilized to perform the gamma correction for a particular set of pixel data. As such, multiple windows in a display may be supported simultaneously where each window employs a different gamma correction curve. Similarly, platforms can be equipped with multiple gamma correction curves, thus allowing applications or images constructed for use on another platform to be viewed on a display with proper gamma correction.

Figure 1:
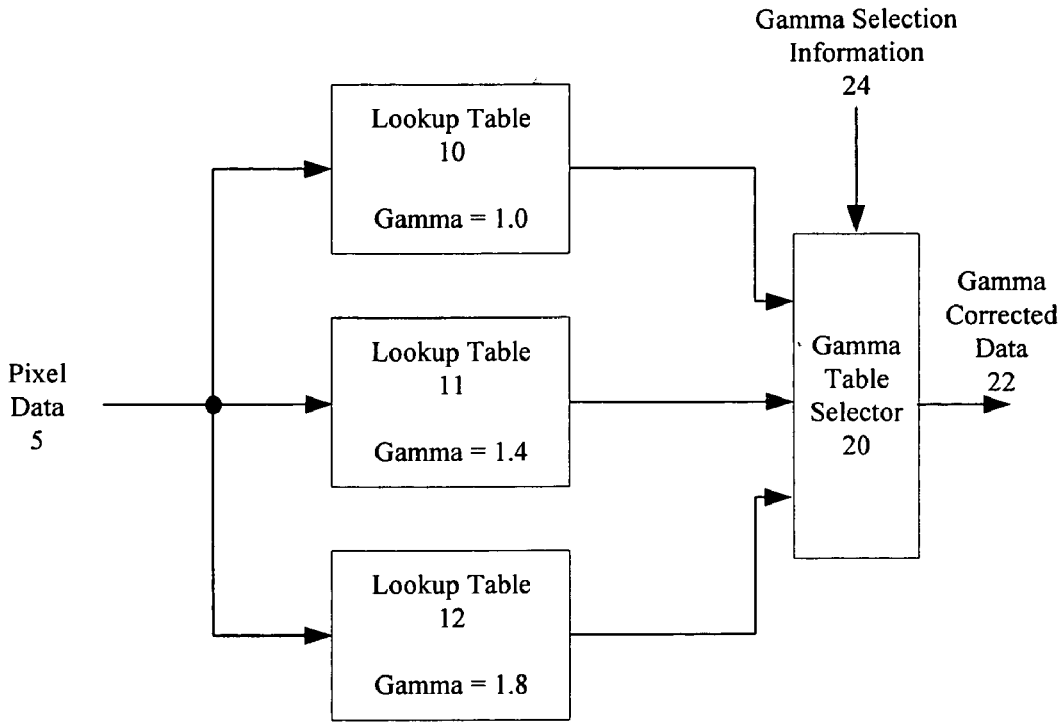
FIG. 1 illustrates a block diagram of a gamma correction circuit in accordance with the present invention.

The invention can be better understood with reference to FIGS. 1–8. FIG. 1 illustrates a gamma correction circuit that includes a plurality of lookup tables 10–12 and a gamma table selector 20. Each of the gamma correction lookup tables 10–12 preferably stores a plurality of sets of output data. Each of the sets of output data represents corrected data that may be provided in response to received pixel data 5. Each of the lookup tables stores a plurality of sets of output data that corresponds to a gamma correction curve for a particular gamma value of the plurality of gamma values. Each gamma correction curve maps values of the received input data, or pixel data 5, to output values on the gamma correction curve. It should be noted that the gamma correction curve may be any type of function that relates a corrected output set of data to an input set of data, and this may or may not be a continuous "curve." Similarly, the corrected output set may represent a gamma corrected version of the input set, or may provide for other functions relating to color adjustment or other manipulations to improve display quality.

In response to the input data, or pixel data 5, each of the lookup tables 10–12 provides a set of output data. The gamma table selector 20 receives these sets of output data and selects a gamma corrected data set 22 from the output data sets produced by the lookup tables 10–12 based on gamma selection information 24.

Preferably, the gamma table selector 20 includes a multiplexer that selects the gamma-corrected data 22 from the plurality of results from the lookup tables 10–12 based on the gamma selection information 24. Thus, the gamma selection information 24 can select the output of one of the lookup tables 10–12.

The input data, which is preferably pixel data 5, indicates a particular color value for a pixel on a display. In some circumstances, the pixel data 5 may already be appropriately gamma corrected. In such an instance, the gamma correction circuit of FIG. 1 will most likely wish to pass through the pixel data without modification. As such, one of the lookup tables included in the circuit may be a simple pass through type circuit, which is equivalent to a lookup table 10 having a gamma of 1.0. Note that the pass through function is preferably implemented without a lookup table as one is not necessary.

In other instances, the pixel data may already be gamma corrected, but it may be gamma corrected for the wrong platform. In those instances, the gamma selection information 24 can select an appropriate lookup table 10–12 that corresponds to the gamma differential between the platform for which the data is gamma corrected and the platform upon which it is actually being displayed. In yet another example, the pixel data 5 may not be gamma corrected in any way. As such, the selected lookup table will perform or approximate the entire amount of gamma correction for the platform. Other cases where the amount of gamma correction may have to be adjusted include those where the display device has an associated gamma that is different than the gamma of a CRT, which is often assumed.

Although the example illustrated in FIG. 1 shows three lookup tables 10–12 having gamma values of 1.0, 1.4, and 1.8, it should be apparent to one of ordinary skill in the art that the number of lookup tables and the gamma values associated with those lookup tables are arbitrary. Thus, in a system that is required to support a number of different displays, or different types of gamma corrected pixel data, additional lookup tables having the appropriate gamma values may be provided to meet the needs of the system.

Preferably, the lookup tables are implemented using one or more memory devices, such as read only memories (ROMs) and random access memories (RAMs). Although many platforms use standardized gamma correction values that could easily be included in a system using ROM lookup tables, additional flexibility is provided through the use of RAM memory. In other embodiments, the standard gamma correction values may be implemented in ROM, whereas an additional one or more lookup tables may be implemented in RAM for flexible addition of other gamma correction values. Typically, the memory structures utilized to generate the lookup tables 10–12 are addressed by the received pixel data 5 to produce the resulting sets of output data.

Figure 2:
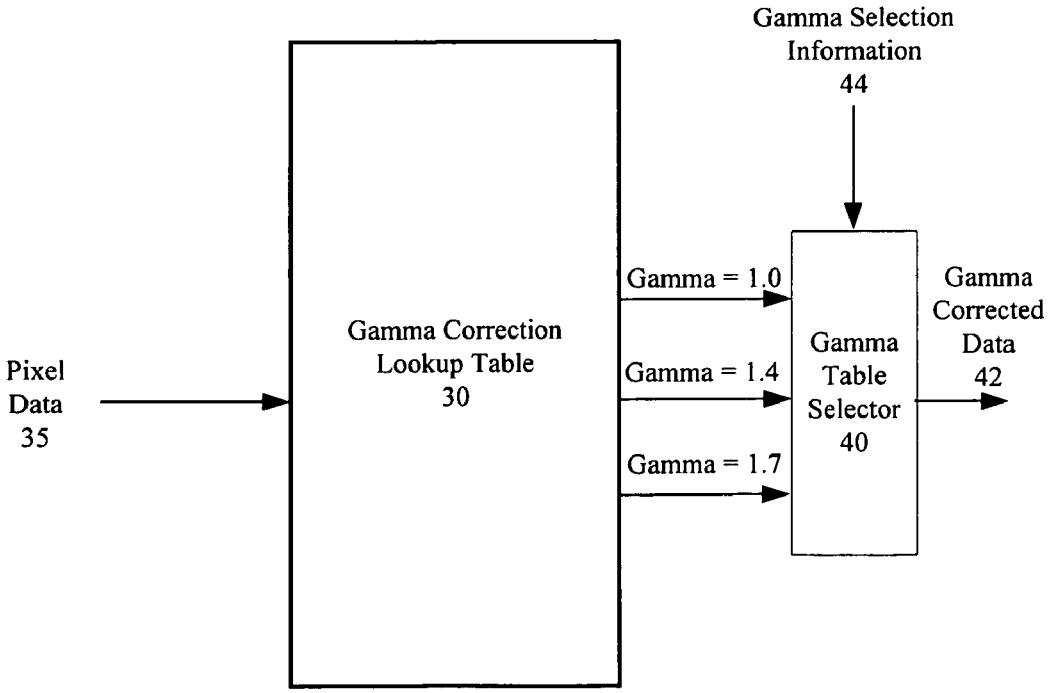
FIG. 2 illustrates a block diagram of a gamma correction block in accordance with the present invention.

Another embodiment of a gamma correction block is illustrated in FIG. 2. The gamma correction block of FIG. 2 includes a gamma correction lookup table 30 and a gamma table selector 40. The gamma correction lookup table 30 preferably stores gamma correction data corresponding to a plurality of gamma correction curves. When presented with the input pixel data 35, the gamma correction lookup table 30 returns a plurality of sets of gamma corrected data in response to the input data. Each of the plurality of sets of gamma corrected data is associated with a particular gamma correction curve. Thus, a single lookup table 30 provides gamma corrected data corresponding to a number of different gamma correction curves in response to input pixel data.

Gamma selection information 44 is provided to the gamma table selector 40 which selects the appropriate gamma corrected data from the plurality of sets of gamma corrected data produced by the gamma correction lookup table 30. The selected gamma corrected data 42 is then provided as an output, which may drive a digital display or be provided to a digital analog converter for conversion to an analog display signal. In other embodiments, the gamma corrected data 42 may be used in further processing rather than being sent directly to the display.

Figure 3:
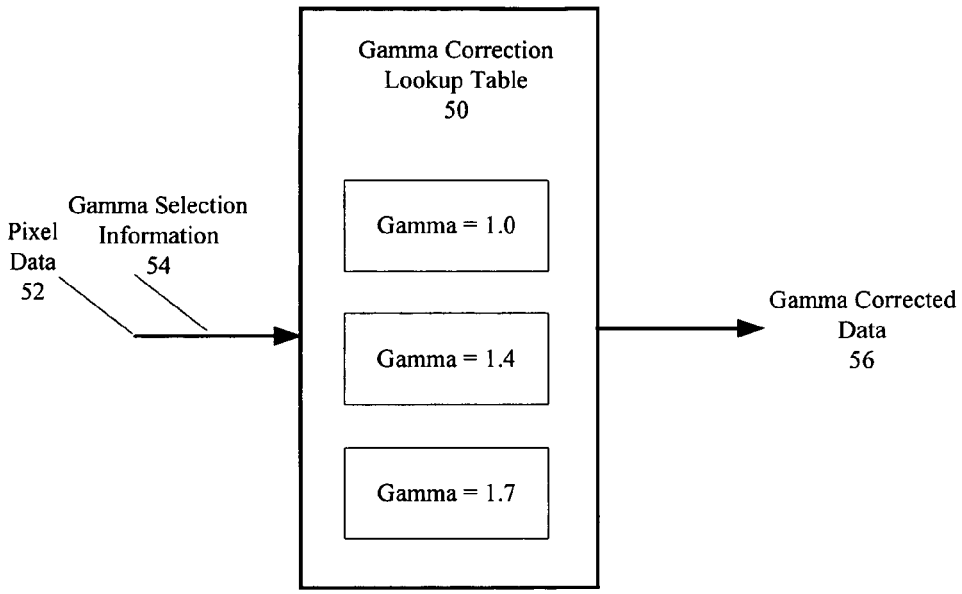
FIG. 3 illustrates a block diagram of another gamma correction circuit in accordance with the present invention.

FIG. 3 illustrates yet another gamma correction circuit. The gamma correction circuit of FIG. 3 includes a gamma correction lookup table 50 that stores gamma corrected data corresponding to a plurality of gamma correction curves. The example illustrated shows the gamma correction lookup table 50 storing gamma correction data corresponding to gamma values of 1.0, 1.4, and 1.7. The gamma correction lookup table 50 is provided with input data that includes pixel data 52 and gamma selection information 54. Thus, a portion of the input data corresponds to gamma selection information, whereas another portion of the input data corresponds to the pixel data to be gamma corrected.

The gamma selection information 54 provided as an input is used to select from the plurality of sets of gamma corrected data corresponding to different gamma values within the lookup table 50. The pixel data 52 is used to select a particular data set from the set of gamma corrected data corresponding to the appropriate gamma value. The set of gamma corrected data selected from the particular gamma correction curve is provided as the output gamma corrected data 56.

The embodiments illustrated in FIGS. 1–3 are preferably implemented on an integrated circuit that performs video graphics processing. In other embodiments, combinations of the gamma correction circuits illustrated in FIGS. 1–3 may be implemented. In one such embodiment, the lookup table stores gamma corrected data corresponding to a plurality of gamma correction curves. The lookup table receives input signals that select a plurality of gamma corrected data sets from the lookup table, where a first portion of the input signals select a portion of the plurality of gamma correction curves. In other words, if the lookup table stores six sets of gamma correction data corresponding to six gamma correction curves, the first portion of the input signals may select two of these six gamma correction curves.

A second portion of the input signals to the lookup table select gamma corrected data sets from these particular curves that were selected by the first portion of the input signals. Thus, in the six gamma curve example, two data sets corresponding to two curves would be provided as output from the lookup table. A selection block operably coupled to the lookup table could then select from these two sets of gamma corrected data based on gamma selection signals to produce the final gamma corrected data set. It should be apparent to one of ordinary skill in the art that applications may exist where more than one set of gamma corrected data may be desired, such as when two monitors having different gamma values are driven. In such instances, it would be straightforward to modify the circuitry described in accordance with the present invention to output more than one set of gamma corrected data.

Another embodiment of the present invention includes a means for storing a plurality of sets of precomputed gamma corrected data corresponding to a plurality of gamma correction curves. Preferably, this means is a memory structure, but registers or other commonly known means of data storage may be employed. The precomputed sets of data require no further mathematical or logical manipulation and represent a number of different approximation samples to the plurality of gamma correction curves. In the case where a memory structure stores the precomputed sets, each output of the memory structure represents gamma corrected data.

A selecting means is operably coupled to the storing means, where the selecting means selects a particular set of gamma corrected data based on received pixel information and gamma selection information. The selection means selects the gamma corrected data set using the gamma selection information to select a particular gamma correction curve from the plurality of gamma correction curves, whereas a particular position on the curve is selected using the received pixel data, or position information. The gamma corrected data provided as an output of the gamma correction circuit is the set of gamma corrected data corresponding to the position on the curve. Preferably, the selection means includes multiplexers and/or address generation blocks that address the storage means to select a particular data set or curve.

Figure 4:
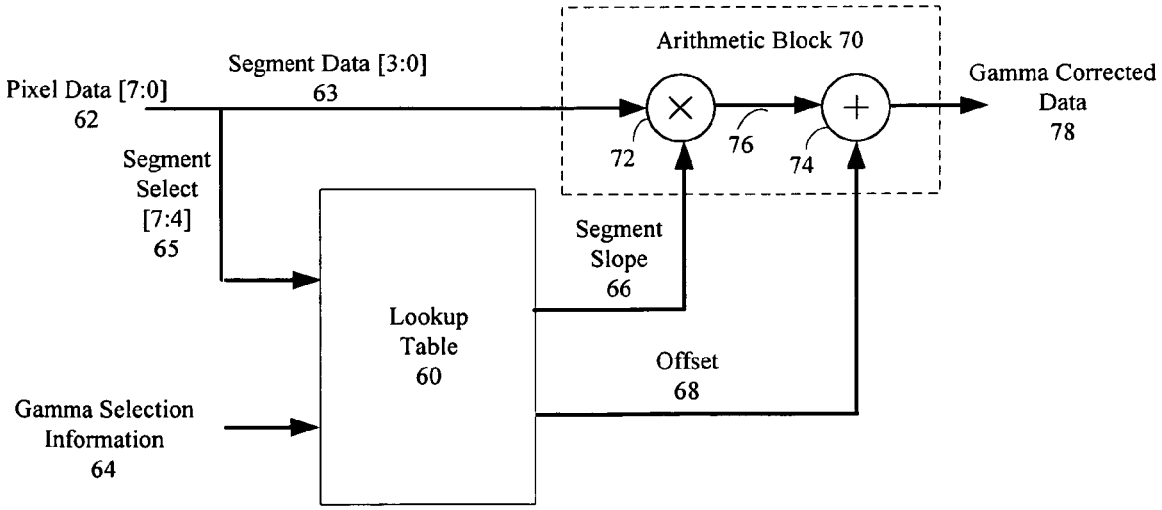
FIG. 4 illustrates a block diagram of yet another gamma correction circuit in accordance with the present invention.
Figure 5:
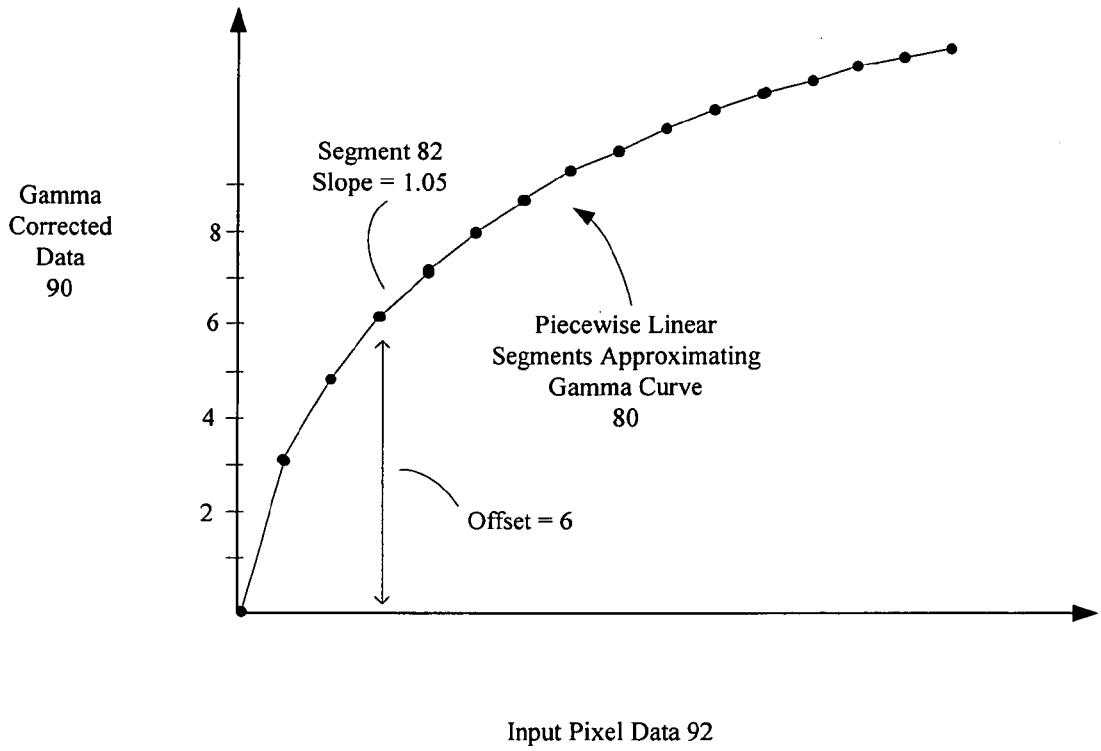
FIG. 5 illustrates a set of piecewise linear segments that approximate a gamma curve in accordance with the present invention.

FIG. 4 illustrates another embodiment of a gamma correction circuit. The gamma correction circuit includes a lookup table 60 and an arithmetic block 70. The lookup table 60 stores slope and offset information corresponding to piecewise linear segments that approximate at least one gamma correction curve. Such a set of piecewise linear segments approximating a gamma correction curve is illustrated in FIG. 5. The graph of FIG. 5 plots the value of gamma corrected data 90 against input pixel data 92. The piecewise linear segments approximating the gamma curve 80 are plotted on the graph to help visualize the operation of the circuit in FIG. 4.

Returning to FIG. 4, the lookup table may store a number of sets of piecewise linear segments that approximate a number of different gamma curves. The lookup table 60 receives gamma selection information 64 that selects one of the sets of piecewise linear segments that approximates a gamma correction curve. The lookup table 60 also receives a portion of the pixel data provided for gamma correction. In the example illustrated in FIG. 4, the pixel data 62 is an eight-bit value, and the most significant four bits, segment select 65, are provided to the lookup table 60. The segment select bits 65 are used to select a particular piecewise linear segment corresponding to the gamma correction curve selected by the gamma selection information 64. The lookup table 60 provides the slope of that particular segment (the segment slope 66) and an offset value associated with that linear segment (offset 68) as outputs. The lookup table 60 is preferably a memory structure, such as ROM, RAM, or some combination thereof. It should be apparent one of ordinary skill in the art that different types of memory structures may be appropriate for different applications.

The arithmetic block 70 is operably coupled to the lookup table 60 and receives the slope and offset information 66 and 68. The arithmetic block combines the segment slope 66 with a second portion of the pixel information, segment data 63, to produce a value on the selected piecewise linear segment. In the example shown in FIG. 4, the segment data 63 include the four least significant bits, which are combined with the segment slope 66 to determine a point on the piecewise linear segment. Preferably, the combination is performed using a multiplier, such as the multiplier 72.

The value 76 corresponding to the point on the piecewise linear segment is then combined with the offset data 68 to produce the gamma-corrected data 78. Preferably, the value of the point on the piecewise linear segment is added to the offset value using an adder 74. The resulting gamma corrected data 78 is an approximation to the actual value on the gamma correction curve that corresponds to the pixel data 62. The accuracy of the approximation will be based on the resolution of the piecewise linear segments, and how closely they are able to track the actual gamma correction curve.

The functionality of the circuit in FIG. 4 may be better understood by referring to an example illustrated in FIG. 5. FIG. 5 shows a particular segment 82 that makes up a portion of a set of piecewise linear segments approximating a particular gamma curve 80. The segment 82 is shown to have an offset value of 6. Thus, any value lying on the segment 82 will have a base value of 6, to which a quantity determined by the position of a point along the line is added to determine the final gamma corrected data value. The most significant bits of the pixel data provided to the circuit in FIG. 4 were used to select the particular set of piecewise linear segments approximating a particular gamma curve 80. The least significant bits are then used to determine the position of a particular point along the segment 82. This is determined by multiplying the slope, shown to have a value of 1.05, by the value of the least significant bits of the pixel data. The offset is then added to the value determined by the slope of the line to determine the final gamma corrected data value 78.

It should be apparent to one of ordinary skill in the art that the circuitry illustrated in FIG. 4 could easily be combined with one or more of the circuit formats illustrated in FIGS. 1–3. Furthermore, a plurality of the gamma correction circuits may be implemented along the data path of a video graphics circuit such that a number of these gamma correction functions may be performed in parallel.

Figure 6:
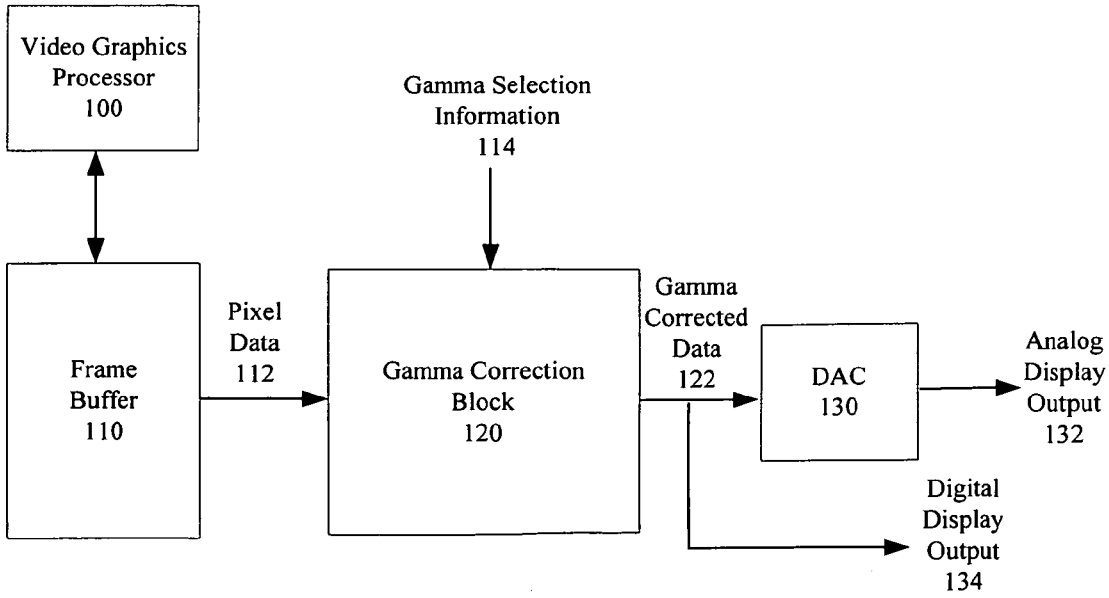
FIG. 6 illustrates a block diagram of a video graphics circuit in accordance with the present invention.

FIG. 6 illustrates a video graphics circuit that preferably employs one or more of the gamma correction circuits that has been discussed thus far. The video graphics circuit includes a video graphics processor 100, a frame buffer 110, a gamma correction block 120, and a digital to analog converter (DAC) 130. The frame buffer 110 stores display information, which is preferably generated or modified by the video graphics processor 100. Pixel data 112 is generated based on the display information included in the frame buffer 110. The pixel data 112 may be a result of word to pixel conversions performed by an additional block coupled to the frame buffer 110, or may be provided directly by the frame buffer 110. The display information stored in the frame buffer 110 may be graphics information, video information, or a combination thereof. The display information is preferably information for display on a display device that has an associated gamma value.

The gamma correction block 120 stores a plurality of sets of gamma corrected data corresponding to a plurality of gamma correction curves. The gamma correction block receives the display information, preferably in the form of pixel data 112, and gamma selection information 114. The gamma selection information 114 may be stored in a register or generated by a controlling device that is aware of the level of gamma correction to be performed.

The gamma correction block 120 provides gamma corrected data 122 in response to received pixel data 112. The gamma corrected data 122 is determined from the set of gamma corrected data associated with a particular gamma correction curve selected by the gamma selection information 114. The gamma correction block 120 may take the form of one of the gamma correction circuits illustrated in FIGS. 1–4, or may be a gamma correction circuit that is based on the principles described concerning those particular gamma correction circuits. The gamma corrected data 122 may be provided directly to a digital display output 134 or may be converted to an analog display output 132 by the DAC 130.

The gamma selection information 114 may be derived from a display list that stores the corresponding gamma selection information for horizontal spans of the display. Different portions of each display line may have different gamma selection information, and as such, the display list may have multiple entries for each line of the display. The display list is preferably included in the frame buffer and may be used for additional purposes to the gamma selection. Alternatively, a set of registers that store coordinates defining windows in the display may be used to indicate the proper gamma selection information for each window. This presents some advantages over the display list in that it may be easier to maintain, but the register approach may also be more limiting in that the number of windows that can be supported is based on the number of registers included in the system.

Figure 7:
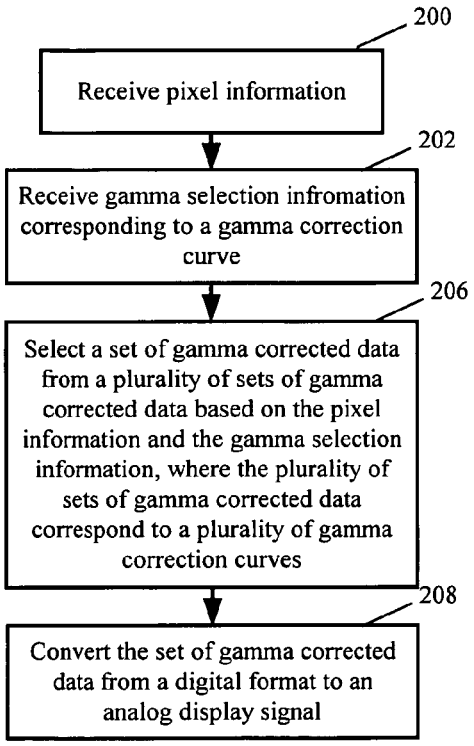
FIG. 7 illustrates a flow diagram of a method for gamma correction in accordance with the present invention.

FIG. 7 illustrates a method for generating gamma corrected data. The method begins at step 200 where pixel information for display is received. At step 202, gamma selection information corresponding to a particular gamma correction curve is also received. At step 206, a set of gamma corrected data is selected from a plurality of sets of precomputed gamma corrected data based on the pixel information and the gamma selection information. The plurality of sets of precomputed gamma corrected data include gamma corrected data corresponding to a plurality of gamma correction curves, and are preferably stored in a block on an integrated circuit. The gamma selection information selects a particular gamma correction curve, where is the pixel information determines a particular set of gamma corrected data on that particular gamma correction curve.

At step 208, the set of gamma corrected data is preferably converted from a digital format to an analog display signal. In other cases, the digital format data may be provided directly to a digital display, or to another processing entity that processes the data and digital format.

Figure 8:
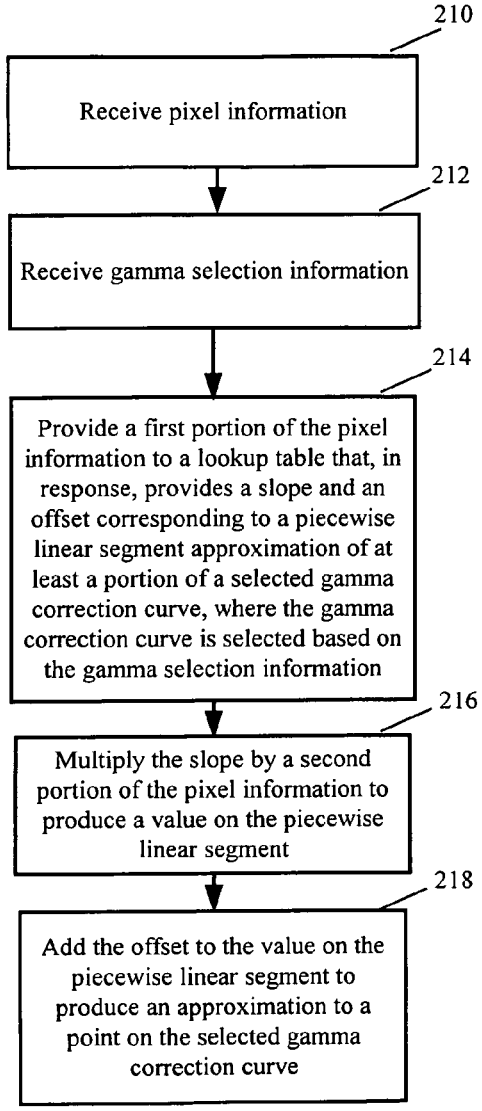
FIG. 8 illustrates a flow diagram of another method for gamma correction in accordance with the present invention.

FIG. 8 illustrates an alternate method for gamma correction of pixel information in a video graphics system. At step 210, pixel information corresponding to an image to be gamma corrected is received. At step 212, gamma selection information is received, where the gamma selection information indicates the amount of gamma correction to be performed in order to place the pixel information at the proper intensity levels for output.

At step 214, a first portion of the pixel information is provided to a lookup table. In response to the first portion of the pixel information, the lookup table provides a slope and an offset corresponding to a selected piecewise linear segment approximation of at least a portion of a selected gamma correction curve. Preferably, the lookup table stores the slope and offset information corresponding to a plurality of piecewise linear segments for each of a plurality of gamma correction curves. The gamma selection information is used to select a particular set of piecewise linear segments corresponding to a selected gamma correction curve. The pixel information is then used to select a particular piecewise linear segment from the set of segments for the curve, and is also used to locate a point along that particular segment. Thus, the first portion of the pixel information selects a particular piecewise linear segment.

At step 216, the point along the piecewise linear segment is determined. This is accomplished by multiplying the slope produced by the lookup operation by a second portion of the pixel information. The result of this multiplication operation is a value on the piecewise linear segment.

At step 218, the offset is added to the value produced through the multiplication operation to produce an approximation to a point on the selected gamma selection curve. The accuracy of the approximation derived at step 218 will be based on the level of accuracy to which the set of piecewise linear segments corresponding to the particular gamma correction curve approximate that gamma correction curve. The resulting approximation is then provided as the gamma corrected data corresponding to the received pixel information, and may be used for display.

It should be understood that the implementation of other variations and modifications of the invention and its various aspects will be apparent to those of ordinary skill in the art, and that the invention is not limited to the specific embodiments described. It is therefore contemplated to cover by the present invention any and all modifications, variations, or equivalence that fall within the spirit and slope of the basic underlying principles disclosed and claimed herein.

What is claimed is:

1. A video graphics circuit comprising:

a frame buffer, wherein the frame buffer stores display information; and a gamma correction block operably coupled to the frame buffer wherein the gamma correction block stores a plurality of sets of precomputed gamma corrected data corresponding to a plurality of gamma correction curves, wherein the gamma correction block receives the display information from the frame buffer and gamma selection information, and wherein the gamma correction block provides sets of gamma corrected data in response to the display information from a plurality of gamma correction curves selected by the gamma selection information, outputting a digital display signal including the sets of gamma corrected data for multiple windows on a display.

2. The video graphics circuit of claim 1 wherein the gamma correction block further includes:

a plurality of gamma correction lookup tables corresponding to a plurality of gamma values, wherein each of the plurality of lookup tables provides a set of precomputed gamma corrected data in response to received display information; and a gamma table selector that receives the sets of precomputed gamma corrected data and automatically selects the sets of gamma corrected data corresponding to at least two sets of precomputed gamma correct data, wherein the automatic selection of the sets of gamma corrected data is based on the gamma selection information.

3. The video graphics circuit of claim 2 wherein the precomputed gamma corrected data includes a pass through function, wherein the pass through function provides the display information as one of the sets of gamma corrected data.

4. The video graphics circuit of claim 2, wherein the gamma correction block further includes at least one gamma correction lookup table storing a plurality of gamma corrected data corresponding to a plurality of gamma correction curves, and wherein the at least one gamma correction lookup table storing a plurality of gamma corrected data provides a set of gamma corrected data to the gamma table selector in response to the received display information by mapping values of the display information to values of the plurality of gamma corrected data using a gamma correction curve of the plurality of gamma correction curves.

5. The video graphics circuit of claim 2, wherein a set of pixel data is provided as the display information to each of a plurality of gamma correction tables, wherein a gamma table selector includes a multiplexor that receives the sets of precomputed gamma corrected data from the plurality of gamma correction lookup tables, and wherein the multiplexor selects at least two selected sets of gamma corrected data from the sets of precomputed gamma corrected data based on the gamma selection information.

6. The video graphics circuit of claim 4, wherein the gamma correction tables are memory structures addressed by the received display information.

7. The video graphics circuit of claim 1 further comprising a digital-to-analog converter operably coupled to the gamma correction block, wherein the digital-to-analog converter receives the sets gamma corrected data and generates an analog display signal, outputting the analog display signal for multiple windows on a second display.

8. A video graphics circuit comprising:

a frame buffer, wherein the frame buffer stores display information;

a gamma correction block operably coupled to the frame buffer wherein the gamma correction block stores a plurality of sets of precomputed gamma corrected data corresponding to a plurality of gamma correction curves, wherein the gamma correction block receives the display information from the frame buffer and gamma selection information, and wherein the gamma correction block provides sets of gamma corrected data in response to the display information from a plurality of gamma correction curves selected by the gamma selection information, outputting a digital display signal including the sets of gamma corrected data for multiple windows on a display; and a video graphics processor operably coupled to the frame buffer, wherein the video graphics processor generates at least a portion of the display information stored in the frame buffer.

9. The video graphics circuit of claim 8, wherein the gamma correction block further includes:

a plurality of gamma correction lookup tables corresponding to a plurality of gamma values, wherein each of the plurality of lookup tables provides a set of precomputed gamma corrected data in response to received display information; and a gamma table selector that receives the sets of precomputed gamma corrected data and automatically selects the sets of gamma corrected data corresponding to at least two sets of precomputed gamma corrected data, wherein the automatic selection of the sets of gamma corrected data is based on the gamma selection information.

10. The video graphics circuit of claim 9 wherein the precomputed gamma corrected data includes a pass through function, wherein the pass through function provides the display information as one of the sets of gamma corrected data.

11. The video graphics circuit of claim 9, wherein the gamma correction block further includes at least one gamma correction lookup table storing a plurality of gamma corrected data corresponding to a plurality of gamma correction curves, and wherein the at least one gamma correction lookup table storing a plurality of gamma corrected data provides a set of gamma corrected data to the gamma table selector in response to the received display information by mapping values of the display information to values of the plurality of gamma corrected data using a gamma correction curve of the plurality of gamma correction curves.

12. The video graphics circuit of claim 9, wherein a set of pixel data is provided as the display information to each of a plurality of gamma correction tables, wherein a gamma table selector includes a multiplexor that receives the sets of precomputed gamma corrected data from the plurality of gamma correction lookup tables, and wherein the multiplexor selects at least two selected sets of gamma corrected data from the sets of output data based on the gamma selection information.

13. The video graphics circuit of claim 12, wherein the gamma correction tables are memory structures addressed by the received display information.

14. The video graphics circuit of claim 8 further comprising a digital-to-analog converter operably coupled to the gamma correction block, wherein the digital-to-analog converter receives the sets gamma corrected data and generates an analog display signal, outputting the analog display signal for multiple windows on a second display.

15. A method for gamma correction in a video graphics system, comprising:

receiving pixel information, wherein the pixel information is generated from display information stored within a frame buffer;

selecting sets of gamma corrected data from a plurality of sets of precomputed gamma corrected data based on the pixel information and gamma selection information, wherein the plurality of sets of precomputed gamma corrected data includes sets of gamma corrected data corresponding to a plurality of gamma correction curves; and outputting a digital display signal including the sets of gamma corrected data for multiple windows on a display.

16. The method of claim 15 further comprising:

converting the sets of gamma corrected data from a digital format to an analog format; and outputting an analog display signal for multiple windows on a second display, wherein the analog display signal includes the converted sets of gamma corrected data.

* * * * *